US007112052B1

(12) United States Patent
Teller et al.

(10) Patent No.: US 7,112,052 B1
(45) Date of Patent: Sep. 26, 2006

(54) POWDER COMPACTING MACHINE

(76) Inventors: Bernd Teller, Beckhauser Strasse 15, 40699 Erkrath (DE); Thomas Hugen, Eipringhausen 44, 42929 Wermelskirchen (DE)

( * ) Notice: Subject to any disclaimer, the term of this patent is extended or adjusted under 35 U.S.C. 154(b) by 0 days.

(21) Appl. No.: 09/744,049

(22) PCT Filed: Jul. 19, 1999

(86) PCT No.: PCT/DE99/02197

§ 371 (c)(1),
(2), (4) Date: Mar. 14, 2001

(87) PCT Pub. No.: WO00/05062

PCT Pub. Date: Feb. 3, 2000

(30) Foreign Application Priority Data

Sep. 20, 1998 (DE) ..... 198 32 520

(51) Int. Cl.
*B02C 4/02* (2006.01)

(52) U.S. Cl. ..... 425/193; 425/237; 100/176; 492/30

(58) Field of Classification Search ..... 425/193, 425/237; 100/907, 155 R, 176; 492/30
See application file for complete search history.

(56) References Cited

U.S. PATENT DOCUMENTS

| | | | | |
|---|---|---|---|---|
| 2,662,002 | A * | 12/1953 | Sunderhauf et al. | 216/9 |
| 2,941,465 | A | 6/1960 | Zimmerli | 100/155 |
| 3,143,769 | A | 8/1964 | Komarek et al. | 18/21 |
| 3,234,769 | A | 2/1966 | Bretschneider | 72/238 |
| 4,608,007 | A * | 8/1986 | Wood | 425/363 |
| 5,069,054 | A | 12/1991 | Hladky et al. | 72/238 |
| 6,092,753 | A * | 7/2000 | Koenig | 241/236 |

FOREIGN PATENT DOCUMENTS

| | | |
|---|---|---|
| DE | 891642 | 8/1953 |
| DE | 19832520 | 2/2000 |
| EP | 0171560 | 2/1986 |
| JP | 59021415 | 2/1984 |

* cited by examiner

*Primary Examiner*—Joseph S. Del Sole
*Assistant Examiner*—Emmanuel S. Luk
(74) *Attorney, Agent, or Firm*—Pandiscio & Pandiscio

(57) ABSTRACT

The present invention concerns a compacting machine, in which the compacting elements can be removed from the compactor housing transversely to the direction of the drive shafts.

8 Claims, 6 Drawing Sheets

POWDER COMPACTING MACHINE

BACKGROUND OF THE INVENTION

1. Field of the Invention

The present invention concerns a powder compacting machine.

Such a compacting machine is presumably generally known; see, for example, the prospectus "The Powder Compacting/Granulating Machine RC 100×30 for Laboratory and Production."

Although this is not intended to signify a restriction of the invention, such compacting machines according to this invention are preferably designed for small throughputs and thus for processing small batches of no more than about 2 kg.

2. Description of the Prior Art

A particular problem with such compacting machines designed for small-batch processing is the inevitable waste that remains in the compacting machine after the processing of the batch. In practice, the powder to be processed, settles in the compacting machine and does not pass into the usable discharge from the machine. If a different batch is to be processed in the next run, the compacting machine has to be taken apart and cleaned. The amount of residue lift in the compacting machine should therefore be as small as possible.

It is, therefore, a basic requirement that the compacting machine be easily accessible and easy to dismantle. This is achieved with some compacting machines by means of a so-called cantilevered bearing for the drive shafts. In these compacting machines, the compacting elements can be accessed from the front without the need to remove the drive shafts.

However, a serious disadvantage of the cantilevered bearing is the substantial bearing forces created by the lever action. These high bearing forces make design an onerous process and result in relatively high machine production costs.

One way to design compacting machines for higher stability under load is to support the drive shaft at both ends. With this type of support, the live load is distributed practically evenly on the bearings. A major disadvantage of this support arrangement lies in the onerous assembly work that must be performed in order to clean the compacting machine.

SUMMARY OF THE INVENTION

It is therefore the object of the invention to improve the known compacting machine so that it has high stability under load and so that the compacting roll can be replaced quickly without disassembly of the bearing.

The invention provides the advantage that given the minimal residue and thus the minimization of rejects after the processing of a batch, the take-down and set-up time involved in cleaning the compacting machine is minimal. In addition, the rolls are easily replaceable; rolls with different surfaces can be removed and installed quickly and easily.

This advantage is achieved by successfully integrating the principle of compacting machines with a drive shaft supported at both ends, in a configuration that affords easy access to the roll fastening means without the need to remove the bearing located in front of it.

It is of essential importance for the invention that the drive shaft is supported at both ends. The plane of rotation of the compacting elements lies in the intermediate region between the bearings. Normally, these elements are a pair of compacting rolls that mesh with each other synchronously to form a contactless roll gap. The powdered material is fed into the compacting gusset and is forced through the convergent geometry into the roll gap, where the compacting takes place.

The convergent compacting gusset thus is the site of formation of substantial pressures that act on the drive shafts and must be conducted away from them via the drive-shaft support.

When the drive shaft is supported at both ends, in practice each of the two bearings absorbs from the drive shaft only half the total compressive force generated, and there is no need to consider multiplicative lever arms and thus bending moments.

The tripartite nature of the drive shaft is of essential importance in practice. It results in two stub shafts, each of which is supported in one bearing, while the midsection of the shaft is fixedly connected to the compacting roll. The bearing stubs and the shaft midsection comprise mutually assigned rotary drivers; these rotary drivers can be brought into or out of engagement, for example transversely or longitudinally with respect to the longitudinal axis of the drive shaft.

In this way, in at least one position of rotation the shaft midsection can be removed from the drive shaft transversely to the longitudinal direction, along with the compacting roll. The entire enclosure surrounding the compacting elements thus becomes readily accessible and can be cleaned with very little effort.

It is further essential that the rotary drivers be coupled in a torsion-proof manner to the complementary rotary drivers by means of an axial clamping device that presses each of the two stub shafts from a respective end against the shaft midsection.

In practice, this creates a thoroughly rigid and intrinsically torsion-proof shaft connection between the two stub shafts. Despite this fact, the compacting roll can be removed easily along with the shaft midsection, and the compacting enclosure is readily accessible.

During disassembly, therefore, the stub shafts remain in the housing, the existing seals are preserved, the compacting machine can nevertheless be taken apart, reassembly presents no problems, and the next batch can be run.

Crucial for the invention is the combinatorial effect obtained by dividing the drive shaft into three parts, while at the same time an intrinsically torsion-proof drive shaft can be created by means of the rotary drivers as soon as the shaft midsection is inserted between the stub shafts.

The axial clamping device brings about a form-fitting engagement of the mutually assigned rotary drivers, thereby eliminating the possibility of any relative motion, even in the micrometer range, between the stub shafts and the shaft midsection even under operating loads, especially as a result of shear stress.

The result is an easy-to-remove but intrinsically completely rigid drive shaft that remains operationally reliable even under elevated operating loads. Thus, the invention is also especially suitable for compacting machines with hydraulic gap-width adjustment. It should be kept in mind in this regard that the operating loads increase with decreasing width of the compacting gusset. The resulting mechanical stresses are readily conducted away by the invention.

The use of roller bearings for the stub shafts offers the advantage of freedom from maintenance combined with easy action.

In addition, the stub shafts in their component housings can be sealed off from the compactor housing by means of rotary shaft seals.

The use of cylindrical roller bearings further provides the advantage of high ratios of outer to inner diameter.

The bearing cross sections of the drive shaft can be thus dimensioned large enough to permit the use of hollow shafts.

Hollow shafts further offer the advantage that the axial clamping device can be realized as a clamping screw that extends from one stub shaft through the shaft midsection into the other stub shaft and is screwed thereinto, while being braced by the underside of its screw head against the first stub shaft.

Since the clamping screw with its screw shank is practically free of play in the throughpassing bore in the shaft midsection and also occupies the adjacent bores in the stub shafts, there is created between the stub shafts a continuous connection that is loaded practically exclusively in bending. If cylindrical roller bearings are used, therefore, the cross section of the screw shank can be selected as sufficiently large to conduct away even the highest operating loads.

Since the screw shank is stressed only in bending, a clearance to transition fit between the continuous bore and the screw shank is sufficient. A press fit is not necessary.

In addition, the clamping screw can be equipped with a forcing device to facilitate removal. Since the use of cylindrical roller bearings makes it possible to construct the drive shaft as a large-diameter hollow cylinder, rotary drivers realized as tongue-and-groove combinations will be sufficient to transmit the torques that arise. Each such tongue-and-groove combination extends secantially or diametrically to the drive shaft. Tests have shown that just one tongue-and-groove combination can suffice for each pair of rotary drivers. This does not exclude the possibility of other embodiments, however.

BRIEF DESCRIPTION OF THE DRAWINGS

The invention is described in more detail hereinbelow with reference to exemplary embodiments. In the drawings.

DESCRIPTION OF THE PREFERRED EMBODIMENTS

Figure 1:
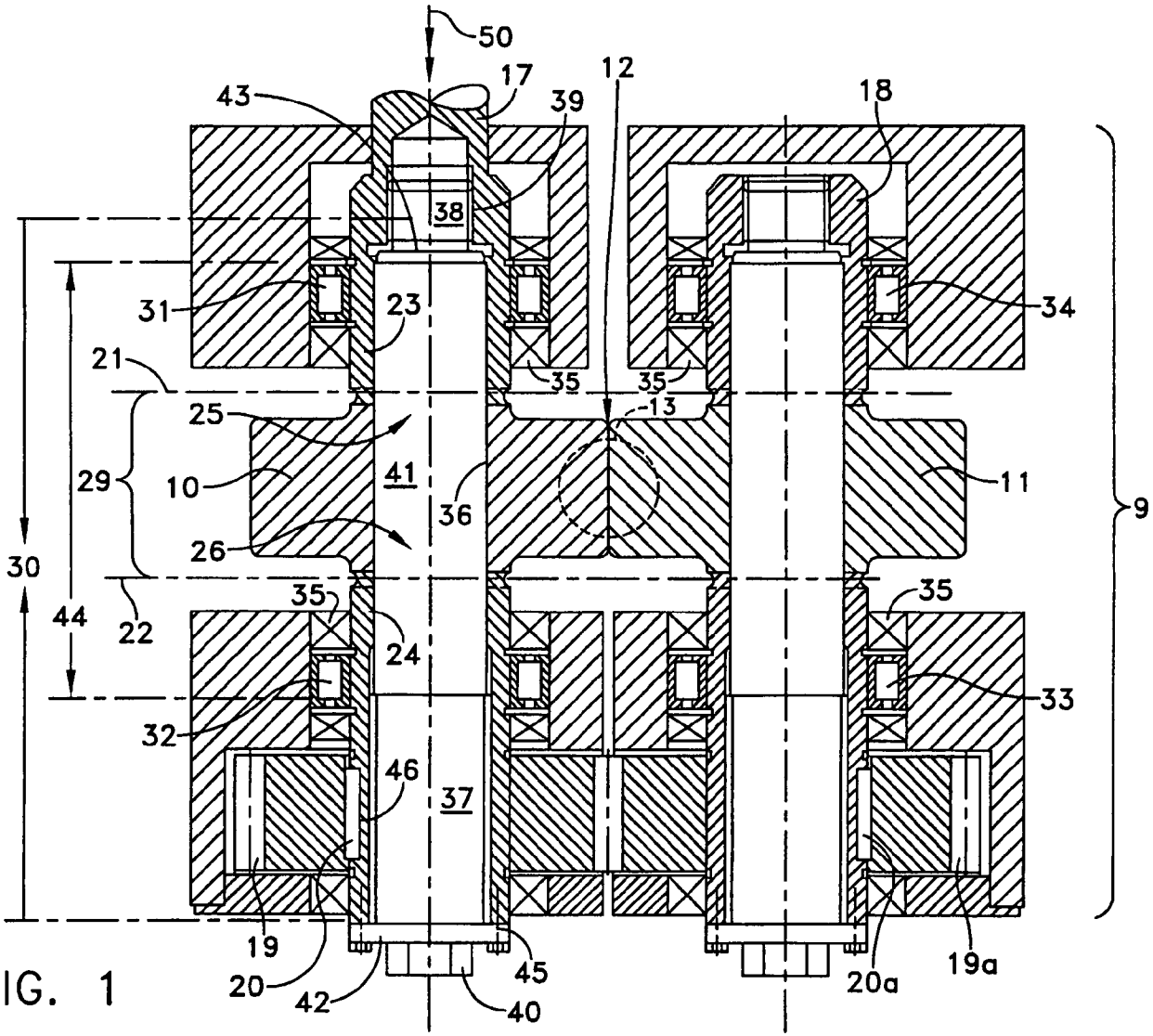
FIG. 1 shows an exemplary embodiment of a compacting machine according to this invention.

Well known in the state of the art are powder compacting machines where a vertical filler neck is mounted in a machine frame whose fill opening is accessible from the outside.

It is also well known that the filler neck opens into a vertically disposed feed hopper. A stirring device revolves in the convergent region of the hopper. A screw feeder is coupled coaxially to the stirring device. The stirring device and the screw feeder are driven via an angular gear at the top end of feed hopper. The drive is a worm motor coupled to the input end of the angular gear.

The fed-in power is conveyed by the screw feeder to the compacting plant, which is disposed under the feed hopper.

The compacting plant essentially comprises two compacting elements 10, 11. In the present case, these are two compacting rolls disposed mutually in parallel, the distance between the axes of the rolls being slightly greater than the sum of the radii of the two rolls.

This creates, below the outflow area of feed hopper, a convergent compacting gusset 12 into which is fed the powder leaving the discharge opening 13 of the screw feeder.

The rotating movement of the compacting rolls is such that their surfaces in the compacting gusset have velocities of identical direction and magnitude.

With respect to the powder fed in for compaction, in the longitudinal direction of the compacting gusset there is consequently no relative velocity between the two surfaces of the compacting rolls. Thus, full use is made of the taper of the gusset geometry in compressing the powder that is introduced. If the rolls are smooth-surfaced, so-called scab is produced, which can then easily be granulated. The rolls can also have recesses that fit together, e.g. for briquetting or pelletizing.

Although this is not intended to signify a restriction of the invention, in the exemplary embodiment shown the compacting rolls are always identical and arranged in pairs, for reasons of symmetry. The direction of rotation of the compacting plant 9 is imparted by the compacting-plant motor, which is connected either via a transfer gearbox to a respective one of the two drive shafts of the compacting elements 10, 11, or merely to one of the drive shafts. In that case the first drive shaft drives the second via a spur-gear pair, thereby also driving the second compacting element.

A downstream processing operation, e.g. a granulating plan 16, can be disposed at the outlet 15 of the compacting machine.

An essential feature of such compacting machines is the compacting elements rotating synchronously in pairs, which do not contact each other, but leave a compacting gusset as they mesh circumferentially.

FIG. 1 shows additional details in this regard.

The figure shows that the compacting plant is symmetrical in structure and is composed of two compacting rolls. The drive shaft 17 of the first compacting roll 10 is connected in a torsion-free manner to the compacting-plant motor. The flux of force proceeds from compacting-plant motor through drive shaft 17 to the gear 19 disposed at the end. This gear is permanently engaged with an additional spur gear 19*a*, which is coupled to the drive shaft 18 of the second compacting roll 1.

To this end, each spur gear 19, 19*a* is coupled to the appropriate drive shaft via an adjusting spring 20, 20*a*. The geometrical radii of the spur gears 19, 19*a* are the same, and the rotational speeds of the two compacting rolls are therefore identical.

The foregoing amended paragraphs of the specification include amendments shown in the following versions with markings to show changes made.

It is essential that drive shaft 17—and likewise drive shaft 18—forms, in each of the longitudinal regions forward and aft of its compacting roll 10 or 11, a stub shaft 23 or 24, of which at least the one receiving the torque 50 from drive shaft 17 carries a rotary driver 27 or 28 on its inward end 25 or 26.

For each drive shaft 17 or 18, there is, therefore, a first plane of separation, respectively 21 or 22. The shaft thus is interrupted radially in the longitudinal region between the two planes of separation 21, 22. A piece, so to speak, is removed from the continuous drive shaft. This removed piece constitutes a shaft midsection 29, which is connected to its respective compacting roll 10 or 11. The shaft midsection carries rotary drivers that are respectively complementary to rotary drivers 27 and 28. The rotary drivers are form-fittingly engaged with their respective counterparts.

The rotary drivers are unhindered in the direction transverse to the drive shaft 17 or 18. Thus the compacting roll, along with the shaft midsection, can be removed laterally from between the stub shafts 23, 24 as long as this is permitted by the corresponding rotational position of the compacting plant, the compactor housing being open at the top.

Supplementarily, an axial clamping device 30 is provided which couples the two stub shafts to the shaft midsection in a torsionally rigid manner when the shaft midsection is in its inserted position between the stub shafts.

Thus, the scope of the invention also encompasses the degrees of freedom that exist between stub shafts 23, 24 when axial clamping device 30 is disengaged. Allowing for the type of rotary driver 27, 28 selected, the degrees of freedom must be such as to permit lateral movement of the compacting rolls 10, 11 as soon as the axial clamping device is released.

This can also be accomplished, for example, in that when the clamping device is released, one of the stub shafts can be moved axially far enough so that it can be disengaged from the shaft midsection, so that the compacting roll can then be removed laterally from the compactor housing.

At the same time, however, it is necessary to ensure the required lateral strength for the assembled drive shaft with its compacting roll. This is achieved in the illustrated exemplary embodiment by means of the clamping screw, which constitutes the axial clamping device 30.

This will now be discussed in more detail.

Supplementary, FIG. 1 shows that each of the stub shafts 23, 24 is individually pivot-mounted in a roller bearing 31, 32, 33, 34 in the housing of the compacting machine 9.

In the exemplary embodiment shown, this is a cylindrical roller bearing, which is sealed in the direction of the compactor housing by means of additional rotary shaft seals. In practice, the sealing plane of the rotary shaft seals terminates at the bearing housings for the stub shaft concerned.

Since the cylindrical roller bearings shown permit a high ratio of outer to inner diameter, the two stub shafts, together with shaft midsection 29, can be provided with an aligned bore 36. A clamping screw 37 provided with a thread 38 at its point and serving as the axial clamping device is inserted into aligned bore 36. This thread 38 mates with a female thread 39 in the first stub shaft 23. Clamping screw 37 is in turn braced by the underside of its screw head 14 against the end face of second stub shaft 24. If clamping screw 37 is tightened all the way, this produces an axial bracing force that urges the first stub shaft 23 and the second stub shaft 24 in the direction of the compacting roll 10. Compacting roll 10 is thereby clamped between first stub shaft 23 and second stub shaft 24. At the same time, the diameter of the screw shank 41 is fitted to the bore 36 with a transition fit (e.g. H7, h7 or H7, f8). The region of the transition fit extends from the first stub shaft 23 through the shaft midsection into the second stub shaft 24. Taking into consideration the tensile force exerted by clamping screw 37, a structure is created in the highly stressed region between the drive-shaft bearings that is loaded laterally only in bending and is free from lateral play.

It is essential for the functioning of the clamping screw that only its thread and the underside of its screw head be subjected to axial loads. On the other hand, the larger-diameter shoulder of the screw shank is freely movable axially. There, the screw is merely in direct contact with the walls of the bore 36, so as to absorb the lateral loads without play. The length of the screw shank is therefore less than the length of the mutually aligned bores in the first stub shaft, the shaft midsection and the second stub shaft, extending to the location where the first stub shaft 23 is provided with the female thread for the point of the screw.

Supplementarily, clamping screw 37 is provided at its screw head 40 with a support ring 42 by which clamping screw 37 rests on the free end face of second stub shaft 24 and thereby couples the axial tension into the hollow-shaft combination.

Figure 5:
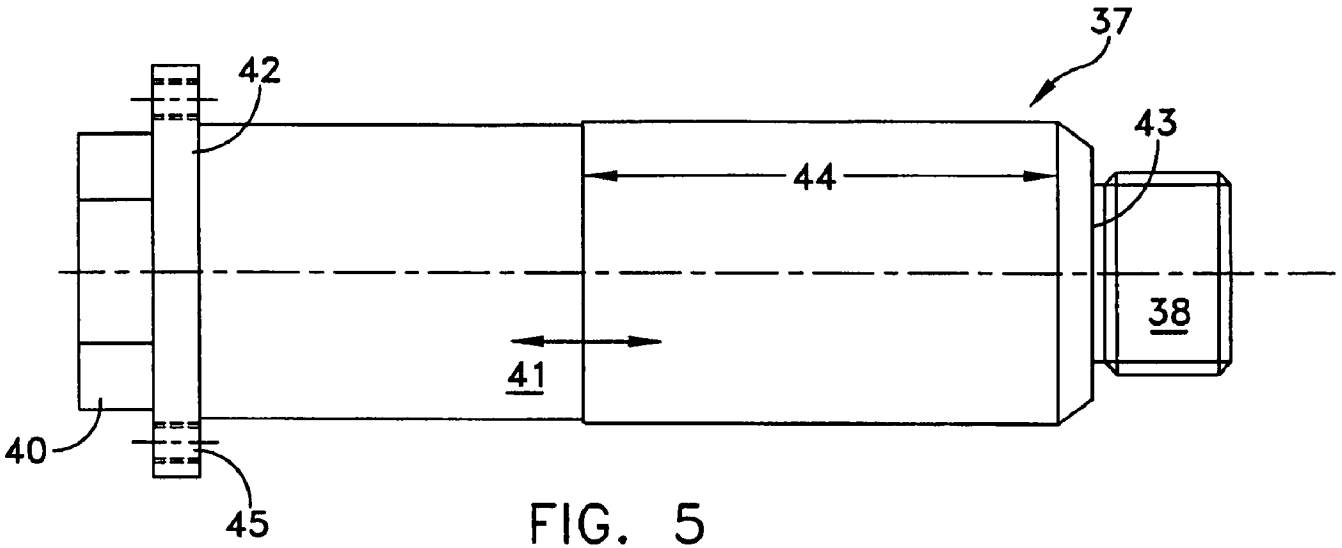
FIG. 5 is a detailed view of an axial clamping screw.

Supplementarily, FIG. 5 shows further details of the clamping screw 37.

As shown therein, the screw shank tapers in the region of the screw point to a smaller-diameter thread 38, which is offset from the screw shank 41 via an expansion zone 43.

The large-diameter screw shank is tapered by a conical lead-in region and then passes into a finish-machined longitudinal region 44. In this finish-machined region, a transition fit is created between the screw shank 41 and the bore 36. This region extends practically into the bearing region of the outer stub shaft 24, so that the requisite tight fit between screw shank 41 and bore 36 can be achieved there.

The screw shank can then continue with a slightly smaller diameter to the screw head 40. The screw head 40 provides a driving flat and a support ring 42, which in the mounted state is seated on the free end face of the second stub shaft 24.

The support ring is provided longitudinally with through-passing threaded bores, which, when the clamping screw is in the assembled state, open blind in front of the end face of the second stub shaft 24.

For removal, it is possible in this case to insert a forcing screw, which then presses clamping screw 37 axially out of its mounted position as screw thread 38 is turned in the loosening direction.

Figure 6:
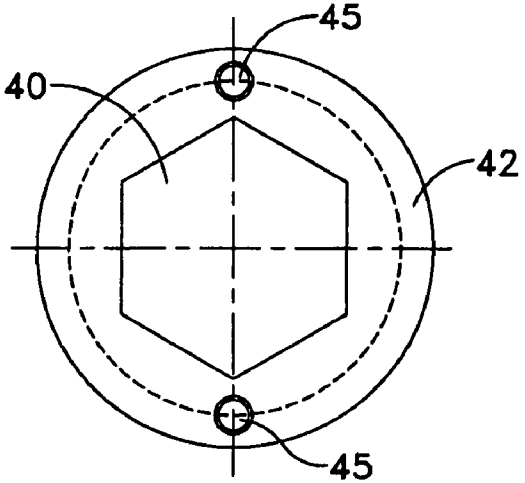
FIG. 6 is a head-end view of the clamping screw of FIG. 5.

As illustrated by FIG. 6 as a supplement to the foregoing, two such forcing screws 45 are disposed opposite each other diametrically to the longitudinal axis of the screw. This prevents any tilting of the clamping screw 37 during its removal.

Figure 2:
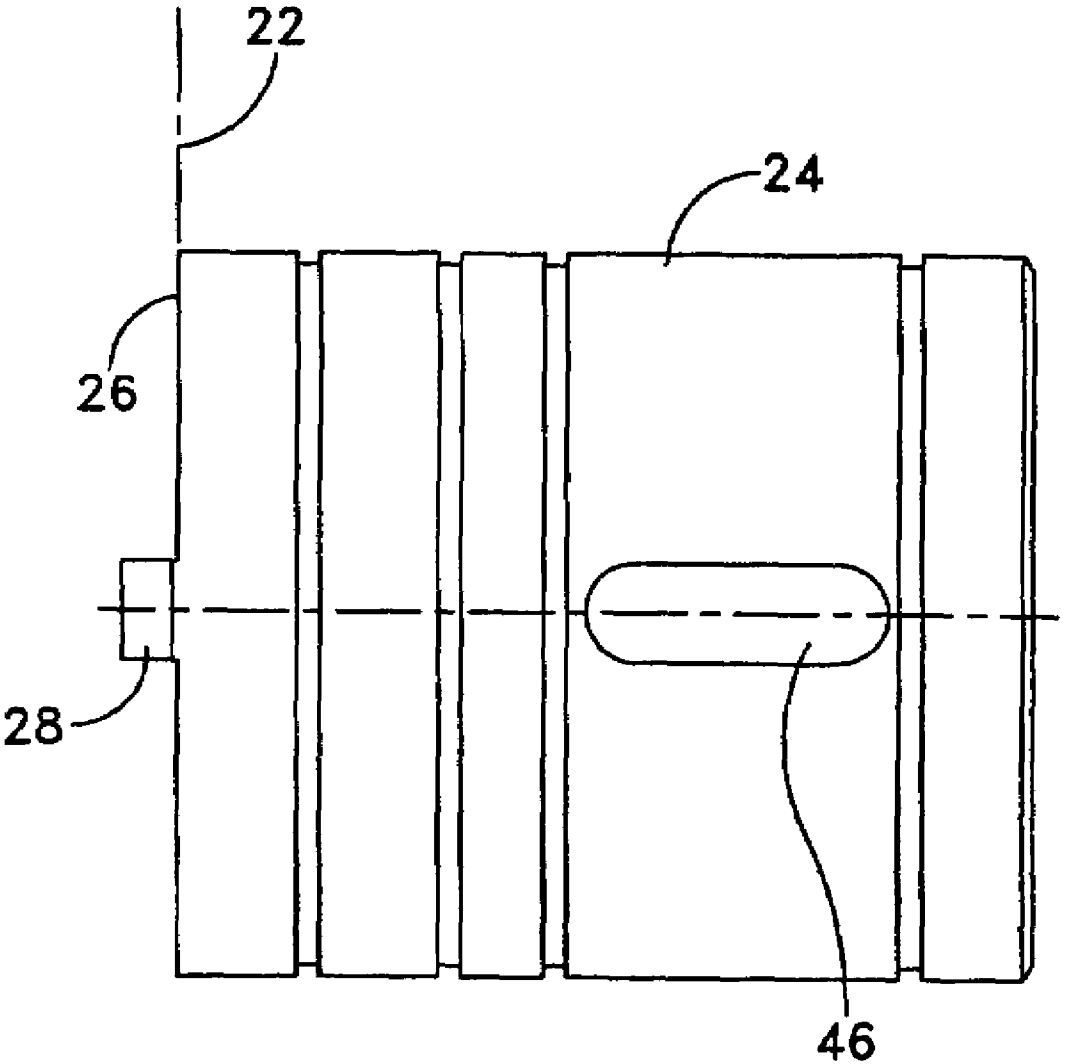
FIG. 2 shows a stub shaft, for example the stub shaft at the driven end.
Figure 4:
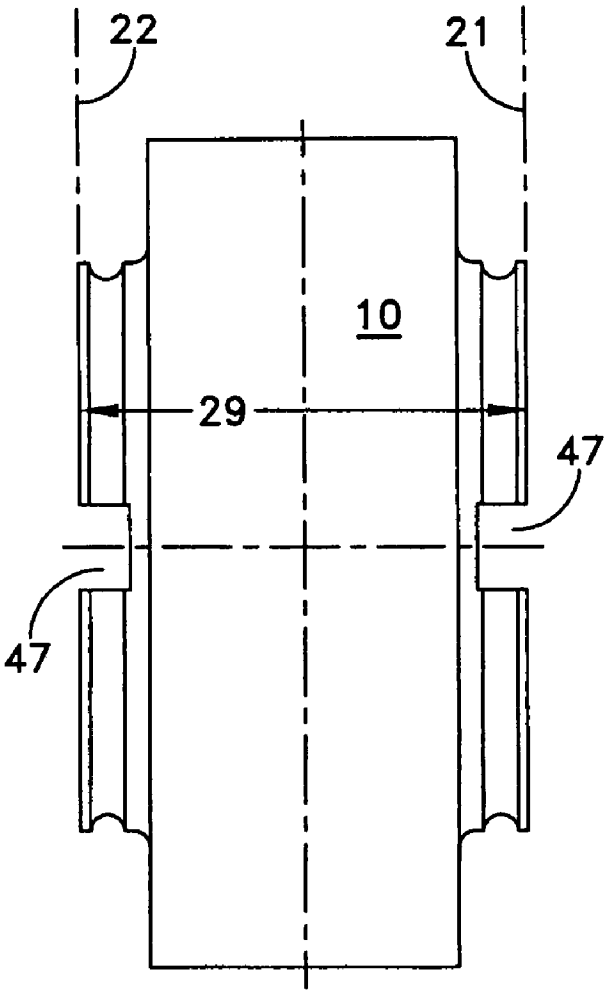
FIG. 4 is a side elevation of a compacting roll with the shaft midsection.
Figure 3:
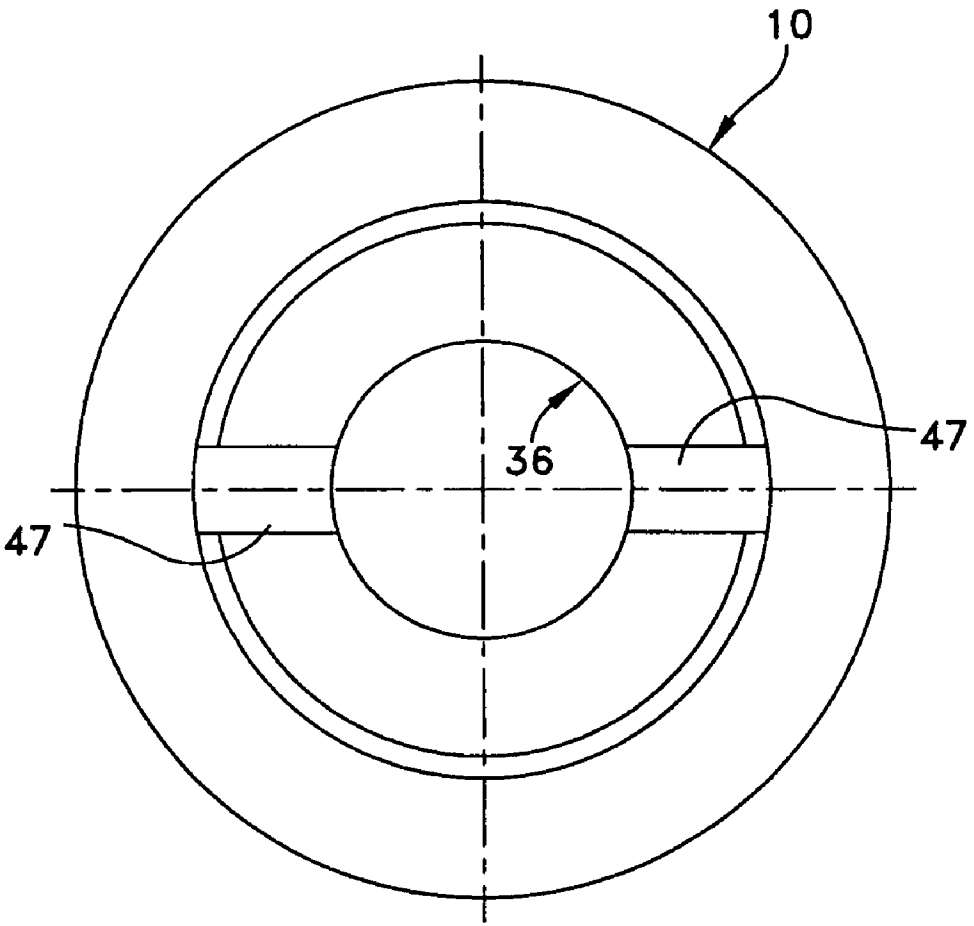
FIG. 3 is a front view of a compacting roll whit the shaft midsection.

As a supplement to the foregoing, FIGS. 2 to 4 show details of the stub shafts and the shaft midsection.

FIG. 2 shows, by way of example, a stub shaft 24 not coupled to the motor 14 of the compacting machine.

In principle, this is a circularly cylindrical hollow body whose outer face has been machined to receive the roller bearing concerned, i.e., it may have annular grooves to secure the roller bearing axially.

Provided on the end comprising the end face is a milled-out portion 46, which serves to receive an adjusting spring 20, 20*a*. A torsion-proof connection is thereby created between stub shaft 24 and the spur gear 19, 19*a* concerned, while at the same time the spur gear can be slid axially onto stub shaft 24.

Additional annular grooves serving as axial fixing means for the spur gear concerned are provided at both ends of milled-out portion 46.

It is essential that provided at the inwardly directed ends of the stub shaft 24 is a diametrically extending spring that creates two projections on the otherwise smooth end surface of the hollow stub shaft.

The end face is, in principle, the radial plane of separation of the drive shaft, from which the rotary drivers project, claw-like, to cooperate with rotary drivers disposed on the shaft midsection and realized as complementary to them.

This situation is illustrated by FIGS. 3 and 4.

Whereas two claw-like projections 28 are provided on stub shaft 24, shaft midsection 29 has two suitably diametrically disposed recesses 47 whose contours are complementary to rotary drivers 27, 28.

Thus, provided that the rotational positions of the stub shafts and the shaft midsection are lined up exactly, once clamping screw 37 has been removed the shaft midsection can be withdrawn transversely to the longitudinal direction of the drive shaft. With it, however, compacting roll 10, which in this case is integrally connected to the shaft midsection 29, can also be removed from the compactor housing at the same time.

Figure 7:
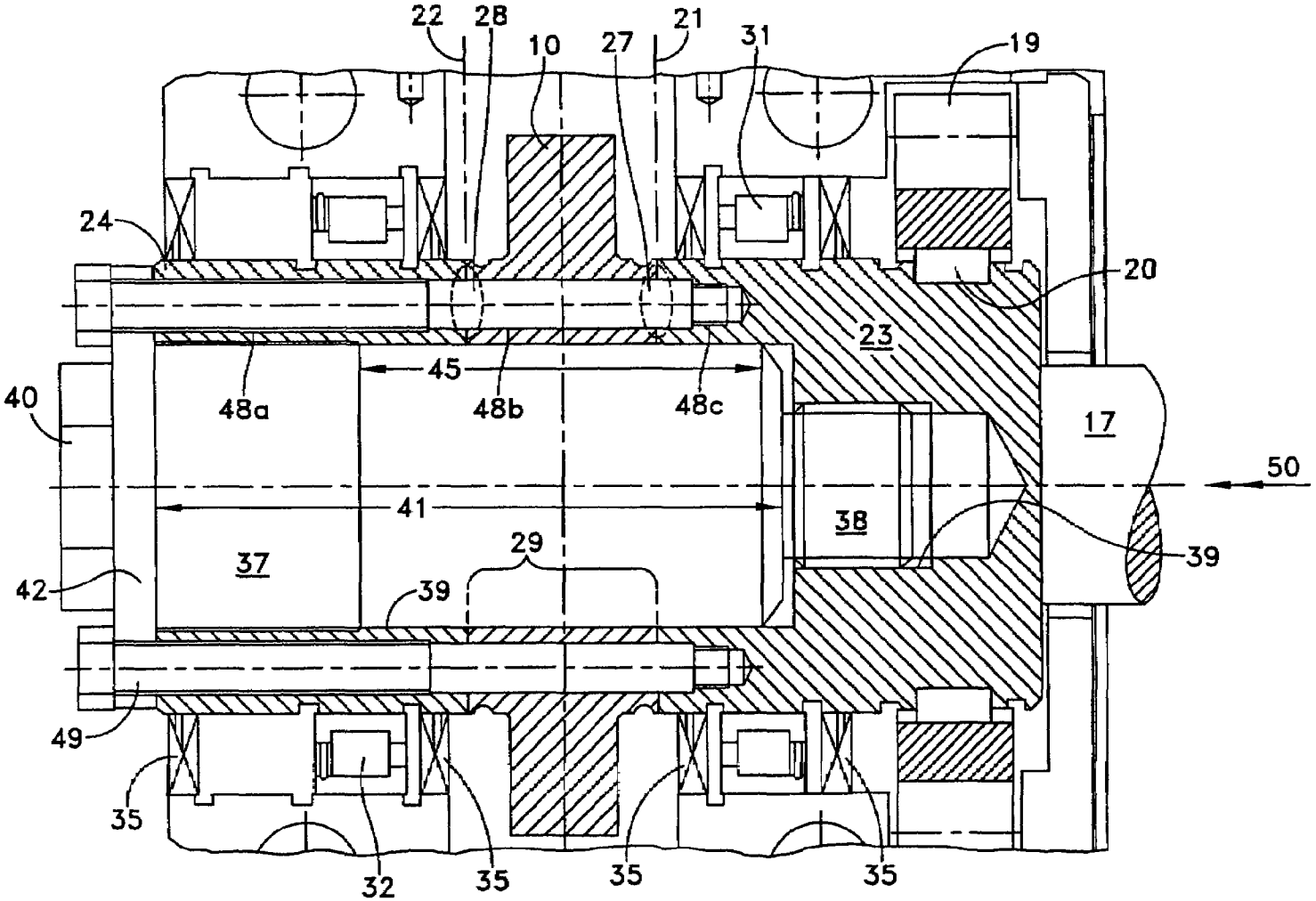
FIG. 7 shows a further embodiment of the invention.
Figure 8:
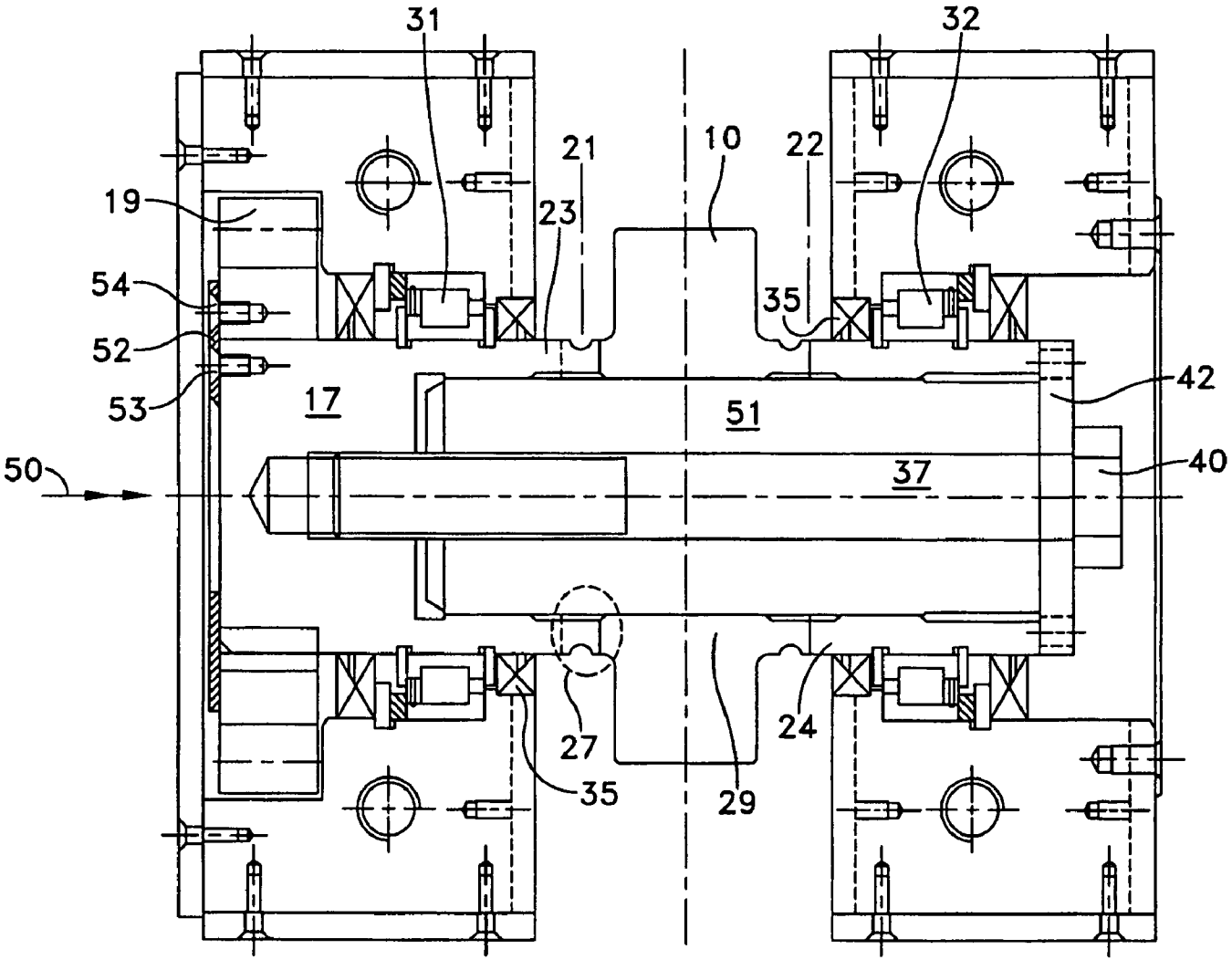
FIG. 8 illustrates yet another exemplary embodiment of the invention.

FIGS. 7 and 8 supplementarily illustrate further particularities.

The foregoing descriptions apply analogously. FIG. 7 depicts a further exemplary embodiment of the rotary drivers 27 and 28.

Here, the rotary drivers are formed by axial bores 48*a, b, c*, made, respectively, in shaft midsection 29 and in stub shafts 23, 24. The axial bores can be placed in a mutually aligned position.

The complementary rotary drivers are formed by a stop pin 49, which passes snugly through axial bores 48*a, b, c*. Stop pin 49 is provided at its insertion end with a male thread, which mates with a corresponding female thread in first stub shaft 23.

Thus, stop pin 49 can be screwed into axial bore 48*a, b, c* until it lies with the underside of its head flush against the outer surface of support ring 42 and can therefore be tightened the rest of the way.

In contrast to the previous representations, FIG. 7 shows as a further particularity that spur gear 19 is disposed at the end of the compacting plant at which the torque 50 is applied by compacting-plant motor 14.

It goes without saying that in this improvement of the invention, the other spur gear 19*a* must be located at the same end of the compacting machine 9.

This measure offers the advantage that theoretically a pair of rotary drivers need be provided at only one end of shaft midsection 29.

Since in this exemplary embodiment the flux of force proceeding from the applied torque 50 is conducted into the compacting machine only to the stub shafts present at that location, the opposite stub shafts are practically torque-free.

FIG. 8 shows supplementarily that in this case the pair of rotary drivers and complementary rotary drivers need be disposed only at the end of shaft midsection 29 where the torques needed for compacting actually must be applied.

At the opposite end, the shaft midsections 29 can have smooth end faces.

Supplementarily, FIG. 8 shows the further particularity that the transmission of torque from drive shaft 17 to spur gear 19 can be effected via a double-bolt drive ring 52 provided with two mutually concentric hole circles. The inner hole circle 53 is disposed within the end face presented by the drive shaft 17. The outer hole circle 54 is within the end face presented by spur gear 19.

Behind the hole circles, corresponding bolt-holes are arranged in alignment in drive shaft 17 and in spur gear 19, thus creating a pair of circularly arranged driving bolts and resulting in torsion-proof transmission of the applied torque 50 to the other drive shaft 18. As a further supplement hereto, the clamping screw 37 is disposed inside a centering sleeve 51. In this way, the lateral forces and bending moments transmitted to the shaft combination via the compacting plant are absorbed by the relatively easy-to-fabricate centering sleeve 51, while the clamping screw 37 can be an economical standard part.

What is claimed is:

1. A powder compacting machine comprising a pair of synchronously rotating compacting elements that mesh with each other circumferentially to define a compacting gusset, a first of said compacting elements comprising a rotatable first compacting roll connected to a first drive shaft assembly;

said first drive shaft assembly comprising a first stub shaft connected to a first side of the first compacting roll, and a second stub shaft connected to a second side of the first compacting roll; said drive shaft assembly being operable to drive said first stub shaft, said first and second stub shafts each being provided with a first claw-like projection integral therewith and engageable with said first compacting roll;

a second of said compacting elements being connected to a second drive shaft assembly, said second drive shaft assembly comprising a third stub shaft connected to a first side of said second compacting roll and a fourth stub shaft connected of a second side of said second compacting roll, and drive shaft assemblies being drivingly interconnected by meshed gears mounted on the second and third stub shafts;

the second of said compacting rolls being in meshing engagement with said first compacting roll and provided with recesses complementary to and adapted to receive said second-claw-like projections on said third and fourth stub shafts:

in at least one rotational position, said second claw-like projections adapted to be slid laterally in between said third and fourth stub shaft claw-like projections to be coupled to said third and fourth stub shaft to connect and disconnect said third and fourth stub shafts; and wherein said stub shafts and said compacting elements are each provided with an aligned bore and wherein a screw shank occupies each bore and the each shank is adapted to serve as a centering bolt for one of said compacting rolls; and wherein the compacting rolls are adapted for removal from the stub shafts and out of the machine without removal of one of the stub shafts.

2. The powder compacting machine in accordance with claim 1, wherein said first stub shaft is provided with a thread for connection to a first of said shanks, and the second stub shaft is provided with a throughpassing bore for said shank, and said first shank is supported by a screw head on an end face of said second stub shaft.

3. The powder compacting machine in accordance with claim 2, wherein said first shank forms at the screw head a support ring provided with at least one thread.

4. The powder compacting machine in accordance with claim 1, wherein said claw-like projections comprise pairs of diametrically extending tongue-and-groove combinations.

5. The powder compacting machine in accordance with claim 1, wherein each of said stub shafts is independently pivot-mounted in a housing of said compacting machine in a roller bearing.

6. The powder compacting machine in accordance with claim 5, wherein each of said stub shafts is mounted in a cylindrical roller bearing.

7. A powder compacting machine comprising:

a drive shaft;

a first stub shaft fixed to said drive shaft and having an axial bore therein;

a first compacting roll removably attached at a first side thereof to an end of said first stub shaft;

a second stub shaft removably attached to a second side of said first compacting roll;

a first rotary gear mounted on said second stub shaft;

said first and second stub shafts, said first compacting roll, and said first rotary gear being adapted for rotation as a first unit;

a second rotary gear engaged with said first rotary gear;

a third stub shaft connected to said second rotary gear and rotatable thereby;

a second compacting roll in meshing engagement with said first compacting roll, and removably attached to said third stub shaft;

a fourth stub shaft removably attached to said second compacting roll; and a fourth stub shaft removably attached to said second compacting roll;

wherein rotation of said drive shaft causes rotation of said first stub shaft, said first compacting roll, said second stub shaft, said first rotary gear, said second rotary gear, said third stub shaft, said second compacting roll, and said fourth stub shaft;

said second compacting roll thereby being driven by said first compacting roll and by said second rotary gear such that said first and second compacting rolls are operationally in contact at a single point during their rotation; and wherein said first and second compacting rolls are removable from the machine and replaceable.

8. The powder compacting machine in accordance with claim 7, and further comprising:

a first adjusting spring disposed between said second stub shaft and said first rotary gear; and a second adjusting spring disposed between said third stub shaft and said second rotary gear.

* * * * *